United States Patent [19]

Davis

[11] Patent Number: 4,486,150

[45] Date of Patent: Dec. 4, 1984

[54] ROTARY PUMP AND IMPROVED DISCHARGE PORT ARRANGEMENT

[75] Inventor: Michael D. Davis, Coldwater, Mich.

[73] Assignee: Eaton Corporation, Cleveland, Ohio

[21] Appl. No.: 368,490

[22] Filed: Apr. 15, 1982

[51] Int. Cl.[3] ..... F04B 23/10; F01C 1/10

[52] U.S. Cl. ..... 417/204; 418/150; 418/225

[58] Field of Search ..... 418/225, 268, 150; 417/204

[56] References Cited

U.S. PATENT DOCUMENTS 2,836,179 3/1958 Klessig et al. ..... 418/225 X 3,589,841 6/1971 Delisse ..... 417/204 X

*Primary Examiner*—Richard E. Gluck

*Assistant Examiner*—Peter M. Cuomo

*Attorney, Agent, or Firm*—C. H. Grace; L. J. Kasper

[57] ABSTRACT

A rotary hydraulic vane pump is disclosed of the type including a cam ring (19) defining an internal cam surface (21). The pump also includes a rotor (25) which defines a plurality of slots (27) which receive roller vanes (29). The internal cam surface includes a discharge arc surface portion (65) which is the cam fall portion of the cam surface. In one aspect of the invention, it is recognized that flow turbulence, pressure pulses and noise is caused by a slight net increase in the volume of a contracting fluid chamber (57) during cam fall, and that this increase is caused by radially inward movement of the roller vane during cam fall. In another aspect of the invention, the discharge port (59) is located such that fluid communication between the contracting fluid chamber and the discharge port does not occur until after the net increase in the volume of the contracting fluid chamber has ceased, and a net decrease in the volume of the chamber has begun.

9 Claims, 7 Drawing Figures

ROTARY PUMP AND IMPROVED DISCHARGE PORT ARRANGEMENT

BACKGROUND OF THE DISCLOSURE

The present invention relates to positive displacement hydraulic pumps of the vane type, and more particularly, to an improved discharge port arrangement for such pumps.

It will become apparent to those skilled in the art from a reading of the present specification that the invention may be used with any type of vane pump, but it is especially advantageous when used in a pump in which the vanes are configured such that radial movement of one of the vanes changes the volume of the adjacent fluid chamber. Therefore, although the invention could be utilized with certain types of slipper vane pumps, the invention appears to have its greatest advantage when used with roller vane pumps, and it will be described in connection therewith.

Pumps of the type to which the present invention relates are shown and described in detail in U.S. Pat. No. 3,025,802, assigned to the assignee of the present invention. Typically, such pumps include a housing defining a pumping chamber, and a pumping element rotatably disposed in the pumping chamber and defining expanding and contracting fluid chambers. The housing means defines a fluid inlet port in communication with the expanding fluid chambers, and a fluid outlet port in communication with the contracting fluid chambers. The pumping element includes a rotor member mounted for rotation with an input shaft, the rotor member having a plurality of slots. Each of the slots receives a radially displaceable vane member which is configured such that radial movement of the vane member changes the volume of the adjacent fluid chamber. The pumping chamber is defined by a continuous arcuate wall surface including an inlet arc surface of progressively increasing radius in the direction of rotation of the rotor member, and a discharge arc surface of progressively decreasing radius.

In pumps of the type described, the housing defines an intake port which permits fluid communication between the fluid inlet port and the expanding fluid chamber, and a discharge port which permits fluid communication between the contracting fluid chamber and the fluid outlet port.

One of the primary problems associated with pumps of the type described is the generation of undesirable pressure pulses during the pumping cycle. Such pulses may be transmitted through the hydraulic lines to the vehicle steering gear which can then translate the pressure pulses into noise, audible to the driver. Pressure pulses and noise emanating from the pump can be generated in several ways, and it has long been an object of those skilled in the art to identify and eliminate such sources of noise and pressure pulses.

Those skilled in the art have for a long time recognized that one of the primary causes of pressure pulses is incorrect timing of the fluid communication between the fluid chambers of the pumping element and the intake and discharge ports. For example, if a trapped volume of pressurized fluid remains in a fluid chamber, just as that chamber begins to communicate with the intake port, the result will be a flow from the fluid chamber into the intake port, in opposition to the normal flow path from the intake port into the expanding fluid chambers. Such a condition will result in flow turbulence and pressure pulses.

Those working in the art have proposed solutions to the readily identifiable errors in the timing of the fluid communication. See for example U.S. Pat. Nos. 3,025,802 (assigned to the assignee of the present invention), and 4,080,124. Many such solutions have proven helpful, and are now being recognized and accepted as good state of the art pump design.

However, pressure pulses and pump noise remain a persistent problem despite such attempts to eliminate all of the readily identifiable timing errors and sources of noise.

Accordingly, it is a primary object of the present invention to identify and eliminate additional sources of pressure pulses and noise which have been previously unrecognized.

During the development of the subject embodiment of the invention, it was observed that there is a slight increase in the volume of the contracting volume chamber, and a small amount of flow into the contracting volume chamber, during the initial portion of the cam "fall", i.e., the period during which the contracting fluid chamber moves along the discharge arc surface.

Accordingly, it is another object of the present invention to identify the cause of this increase in volume of the contracting fluid chamber, and determine its effect upon proper timing of fluid communication between the contracting fluid chamber and the discharge port.

It is a more specific object of the present invention to provide a rotary fluid pump of the type described above in which the discharge port design and location take into account the above-noted increase in the volume of the contracting fluid chamber.

The above and other objects of the present invention are accomplished by the provision of an improved rotary pump of the type described above. Each vane member, being referred to as a leading vane member as it progresses across the discharge arc surface, cooperates with a trailing vane member and the discharge arc surface to define the contracting fluid chamber. The volume of the contracting fluid chamber is simultaneously increased by the radially inward displacement of the leading vane member, and decreased by the progressively decreasing radius of the discharge arc surface.

The improvement of the present invention comprises the discharge port being located, relative to the discharge arc surface, such that communication between the discharge port and the contracting fluid chamber begins at the point at which the decrease in the volume of the contracting fluid chamber, caused by the decreasing radius of the discharge arc surface, approximately equals the increase in the volume of the contracting fluid chamber caused by the radially inward movement of the leading vane member. This particular design and location of the discharge port substantially prevents communication between the contracting fluid chamber and the discharge port until the contracting fluid chamber has undergone a net decrease in volume, with continued rotation of the pumping element, thus substantially reducing fluid turbulence and pressure pulses.

DESCRIPTION OF THE PREFERRED EMBODIMENT

Figure 1:
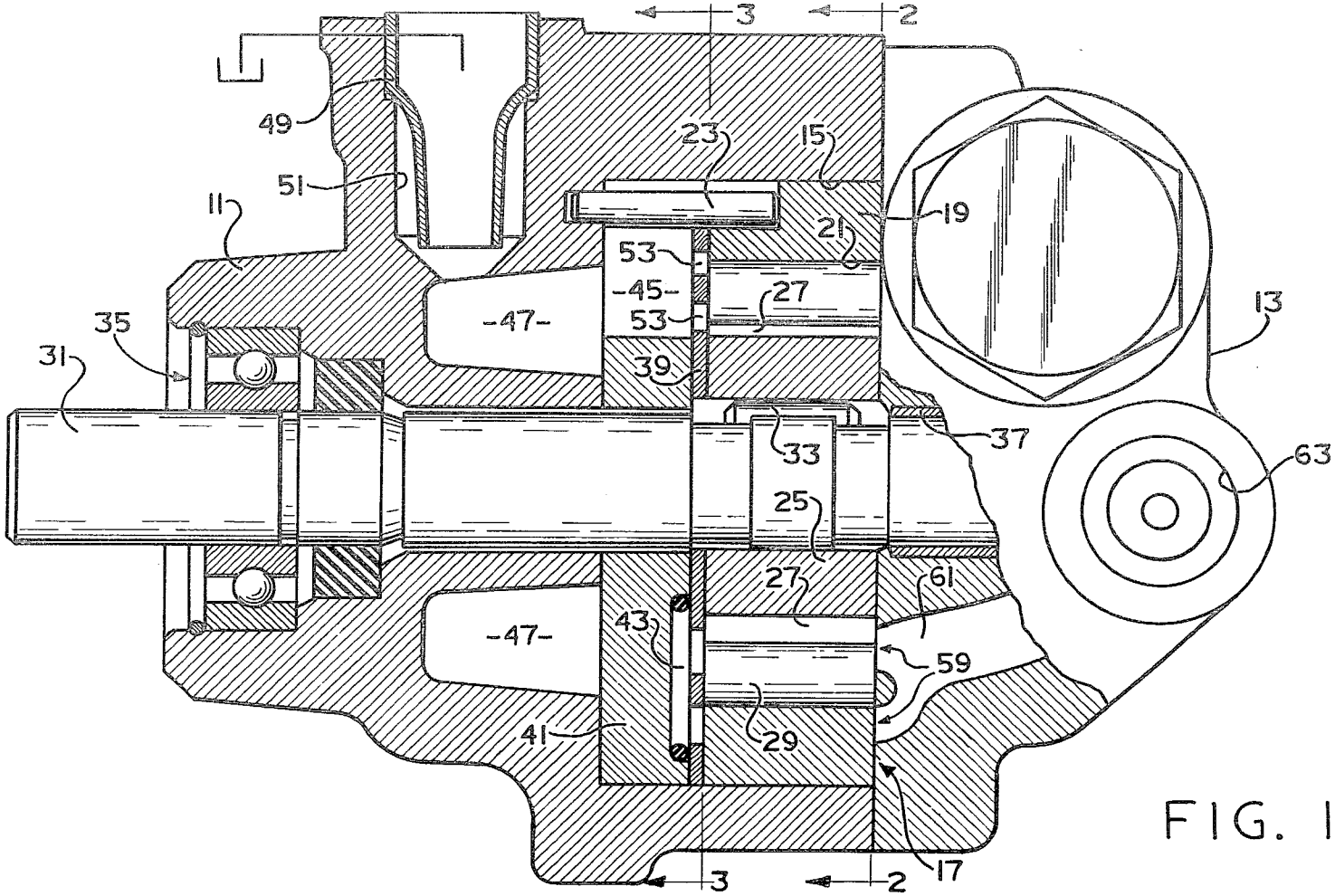
FIG. 1 is an axial cross section of a rotary pump of the type with which the present invention may be utilized.

Referring now to the drawings, which are not intended to limit the invention, FIG. 1 is an axial cross section of a typical automotive power steering pump of a general type which is commercially available and therefore, will be described only briefly herein.

Figure 2:
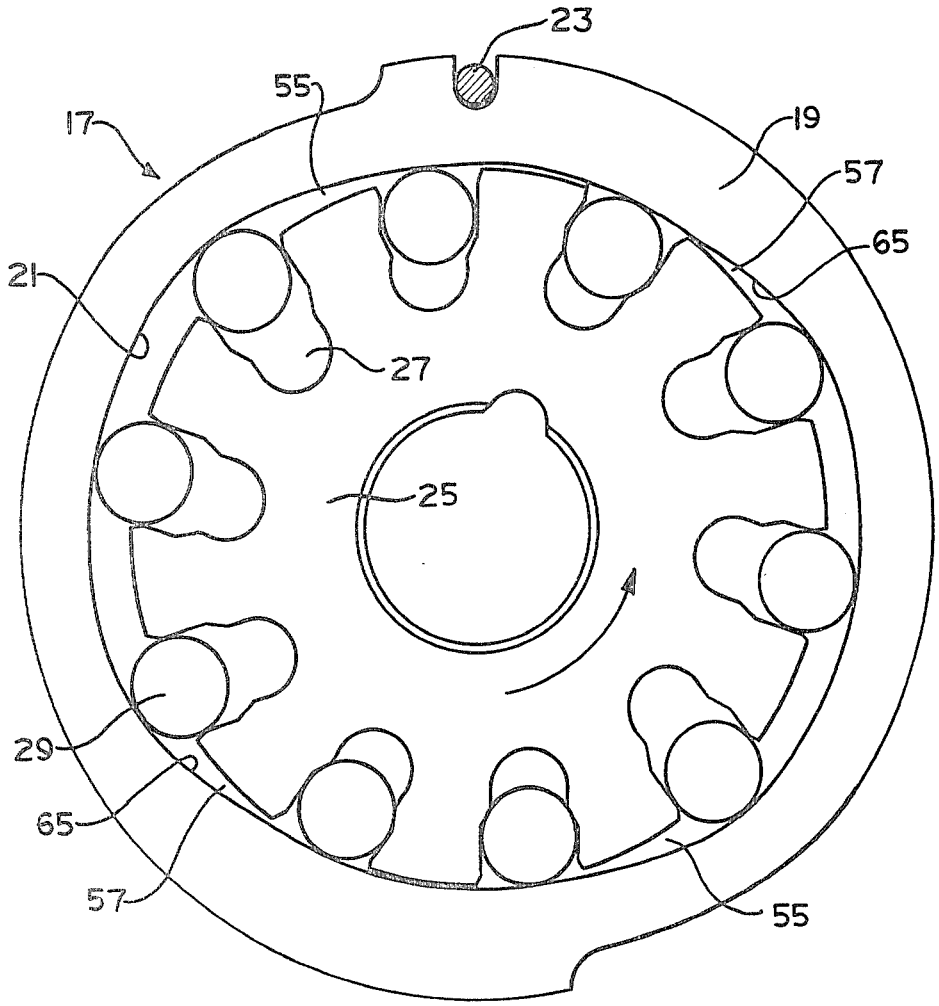
FIG. 2 is a transverse view, taken on line 2—2 of FIG. 1, showing only the pumping element and cam member.

The pump comprises several portions, including a body portion 11 and a cover portion 13. The body portion 11 defines an annular pumping chamber 15, and disposed within the chamber 15 is a pumping assembly 17. Referring also now to FIG. 2, the pumping assembly 17 includes a cam ring 19 which defines an internal cam surface 21. The cam ring 19 is held in proper circumferential alignment, relative to the body portion 11, by means of an axial pin 23. The body portion 11 and cover portion 13 are held in tight sealing engagement by means of a plurality of bolts (not shown).

Disposed within the cam ring 19 is a rotatable pumping element 25 (rotor), which defines a plurality of radially extending slots 27, each of the slots 27 receiving a cylindrical roller 29, as is well known in the art. In the subject embodiment of the invention, there is a relatively close fit between each slot 27 and the respective roller 29. As a result, fluid is not readily communicated radially through the slot, past the roller.

The pump includes an input shaft 31 which is capable of transmitting a rotary motion, such as from the vehicle engine, to the rotor 25, by means of a suitable pin connection 33. The input shaft 31 is supported for rotation within the body portion 11 by a suitable bearing set 35, and is supported for rotation within the cover portion 13 by a suitable bushing member 37. As the rotor 25 rotates, the rollers 29 remain in engagement with the cam surface 21, which is configured to cause each of the rollers 29 to move radially outwardly and inwardly as the pumping assembly 17 accomplishes fluid intake and fluid discharge, respectively, as is well known in the art.

Referring again primarily to FIG. 1, the pumping assembly 17 includes a flexible end plate (port plate) 39 disposed adjacent the left end of the cam ring 19 and rotor 25. Disposed adjacent the end plate 39 is a backup plate 41 which defines a pair of kidney shaped pressure chambers 43 (only one of which is shown in FIG. 1), and a pair of cutout portions 45 (only one of which is shown in FIG. 1). It will be understood by those skilled in the art that not all portions of FIG. 1 are taken on the same plane, but instead, the various elements are positioned as shown in FIG. 1 for the purpose of illustrating all of the important elements of the pump in a single view.

The body portion 11 defines a pair of diametrically opposed inlet chambers 47, each of which is in fluid communication with a system reservoir by means of a reservoir fitting 49, which is seated within a stepped bore 51 defined by the body portion 11. Inlet fluid flows from the system reservoir, through the reservoir fitting 49 into the inlet chambers 47, and from there, through the respective cutout portions 45, and through two pairs of diametrically opposed intake ports 53, and into the expanding fluid chambers 55. At the same time, pressurized fluid is pumped from the contracting fluid chambers 57, then through a pair of diametrically opposed discharge ports 59, and into a discharge chamber 61 which is in fluid communication with a discharge port 63 defined by the cover portion 13. It should be understood that the intake and discharge ports 53 and 59 are being described in connection with FIG. 3 only, merely for simplicity, and that the cover portion 13 includes the same port arrangement as does the end plate 39.

Figure 3:
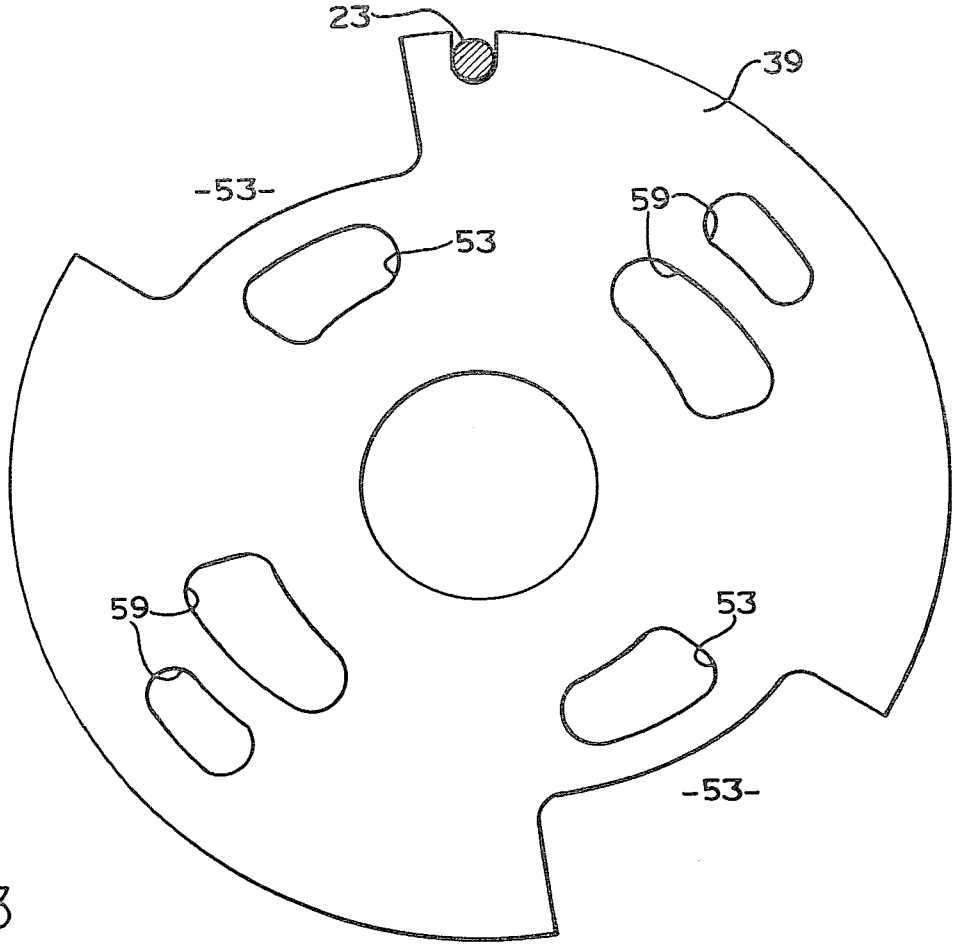
FIG. 3 is a transverse view, taken on line 3—3 of FIG. 1, illustrating only the port plate and the intake and discharge ports in accordance with the present invention.

Referring now primarily to FIGS. 2 and 3, it is believed that those skilled in the art are generally knowledgeable regarding matters such as the varying radius of the different portions of the cam surface 21, and the relative circumferential spacing of these wall portions and the intake and discharge ports 53 and 59. Therefore, the particular geometry of the cam surface 21, rotor 25, slots 27, etc., will not be described in great detail herein. Instead, because such matters are not essential to the present invention, additional information regarding such matters may be obtained by reference to previously cited U.S. Pat. Nos. 3,025,802 and 4,080,124, which are incorporated herein by reference.

Figure 4:
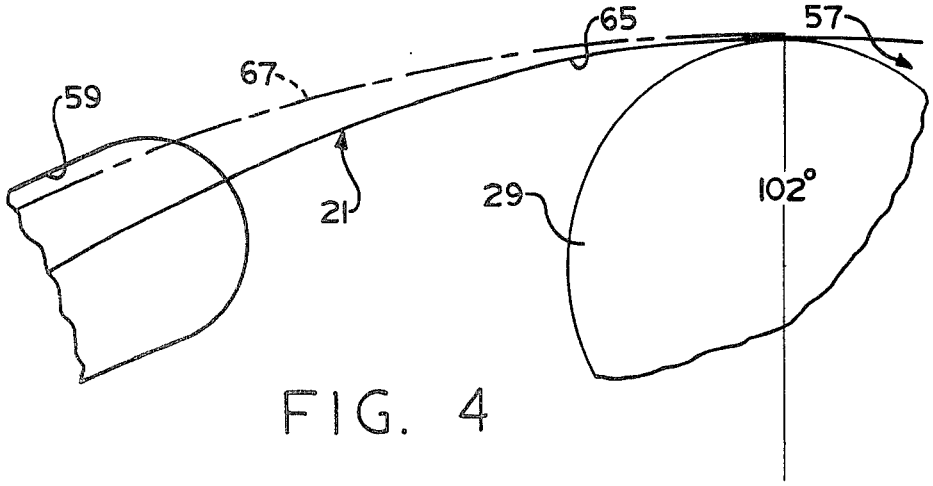
FIGS. 4, 5, and 6 are somewhat schematic overlay views, greatly enlarged, showing the pumping element in three different positions relative to the cam and discharge ports, illustrating the working of the present invention.
Figure 5:
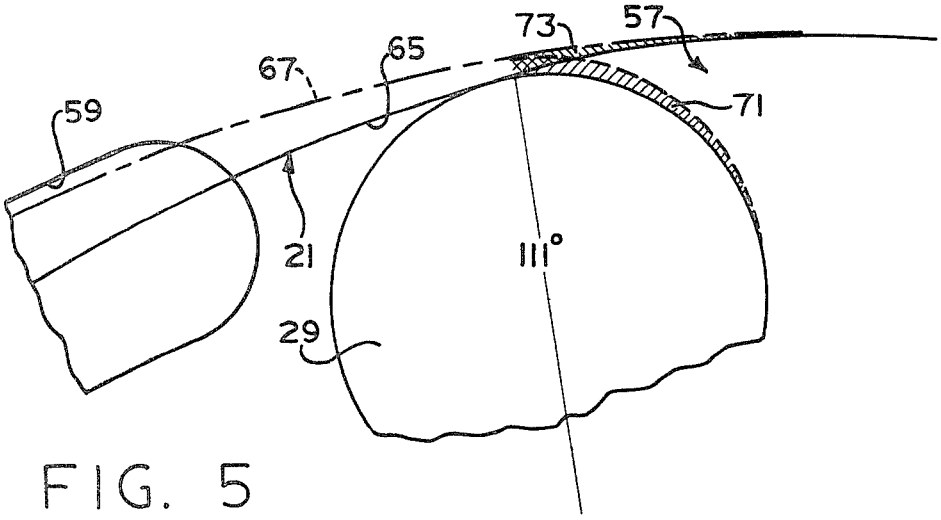
Figure 6:
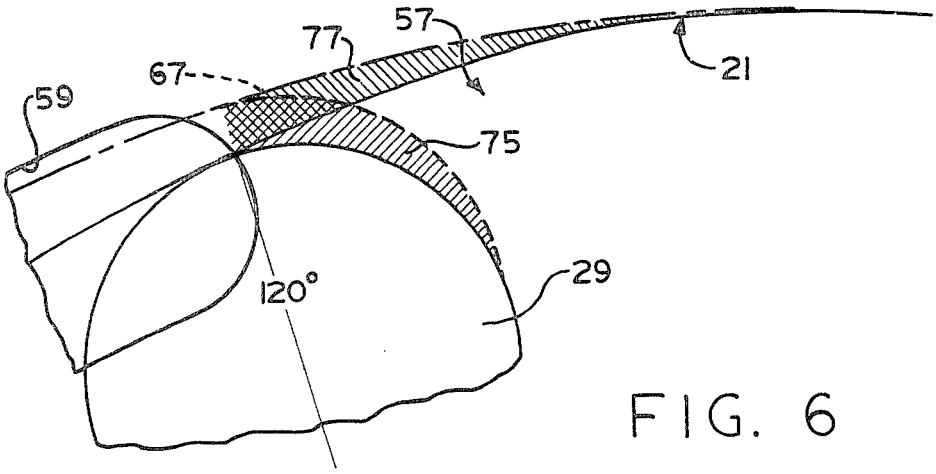

Referring now briefly to FIGS. 4–6, it may be seen that the present invention is concerned primarily with the discharge portion of the pumping assembly 17, i.e., the design and location of the discharge ports 59, relative to the cam ring 19, as the rollers 29 pass through the discharge arc, engaging a discharge arc surface portion 65.

Figure 7:
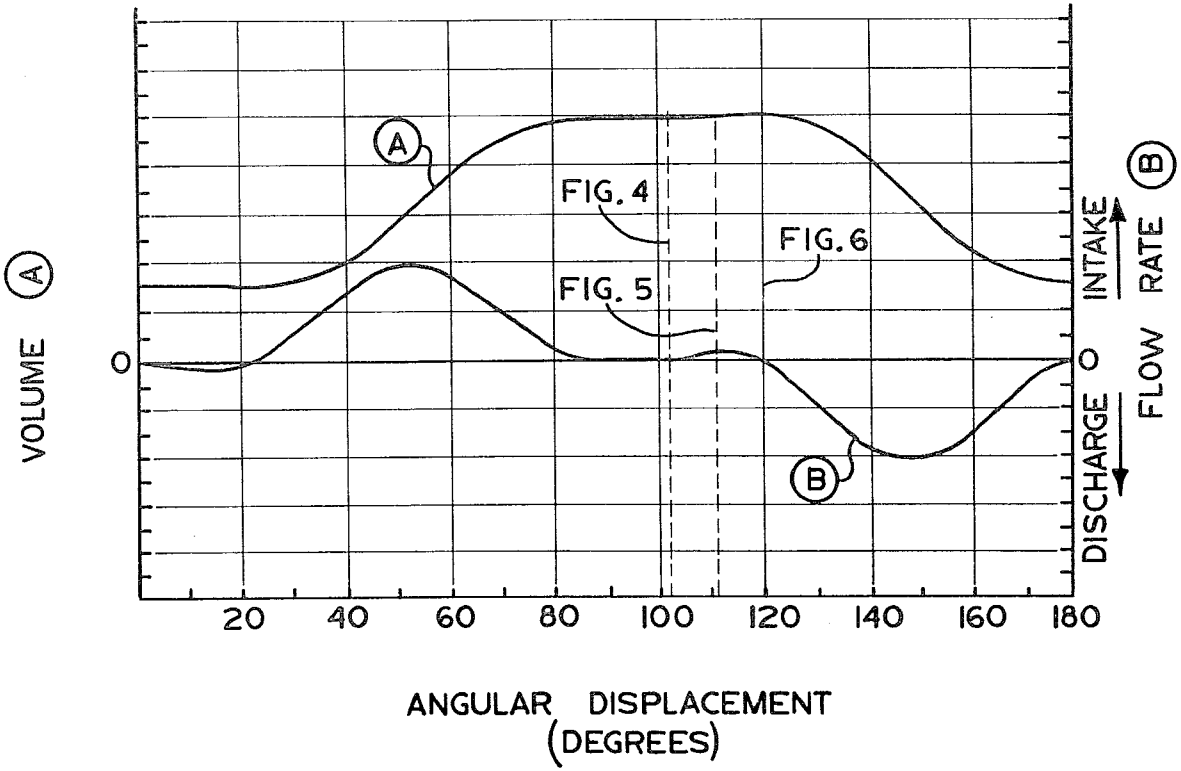
FIG. 7 is a graph of the volume of each fluid chamber, and the flow into and out of each fluid chamber, as a function of angular displacement of the pumping element.

Referring now to FIG. 7, there is shown a graph (labeled "A") of volume of each of the fluid chambers 55 and 57 as a function of the angular displacement of the rotor 25. FIG. 7 also includes a graph (labeled "B") of flow into and out of the fluid chambers 55 and 57, again as a function of the angular displacement of the rotor 25. Because the subject embodiment of the present invention is a balanced pump, the range of angular displacement (180 degrees) shown in FIG. 7 represents one complete pumping cycle. Although the invention is being disclosed in connection with a balanced pump, it should be clearly understood that the invention is not so limited, and it may be advantageously used in an unbalanced pump, i.e., a pump in which there is only one pumping cycle per revolution of the rotor.

Referring now primarily to curve B in FIG. 7, it should be noted that the portion above the horizontal axis, between about 20 degrees and 90 degrees of angular displacement, indicates a flow of fluid into an expanding fluid chamber 55. Conversely, the portion of curve B below the horizontal line, from about 120 degrees to about 180 degrees, indicates a flow out of the chamber as it becomes a contracting fluid chamber 57.

Theoretically, the portion of curve B between the upward and downward portions just described should coincide with the horizontal axis over the displacement from about 90 degrees to about 102 degrees. This is because the radius of the cam surface 21 is constant over this displacement range, meaning that the volume of the fluid chamber remains constant, and there is no flow into or out of the fluid chamber. Beyond about 102 degrees, the radius of the discharge arc surface portion 65 begins to decrease, as the chamber becomes a contracting fluid chamber 57. Thus, the volume of the chamber 57 should be decreasing, which should be indicated by the curve B in FIG. 7 falling below the horizontal axis from about 102 degrees onward.

However, as was mentioned in the background of the specification, it was observed during the development of the subject embodiment of the invention that the curve B in FIG. 7 rises above the horizontal axis in the range of about 102 to 120 degrees, rather than falling below the horizontal axis as expected. It should be noted here that both curve A and curve B in FIG. 7 are computer simulations, using as inputs all of the dimensions of the various parts of the pumping assembly 17.

Thus, it may be seen from curve B in FIG. 7 that from about 102 degrees onward, when the contracting fluid chamber 57 should be decreasing in volume, which would cause pressurized fluid to flow from the chamber 57 into a discharge port, the volume of the chamber 57 is actually increasing. Typically, the discharge port begins to communicate with the contracting volume chamber as soon as cam fall begins to occur (e.g., in the subject embodiment, at about 102 degrees). The slight increase in volume, after the chamber begins communication with the discharge port, permits a slight amount of flow from the discharge port into the chamber 57, or in other words, permits flow in the direction opposite to that which is intended. The result is flow turbulence, pressure pulses, and eventually undesirable noise.

Discharge Port

Referring again to FIGS. 4–6, the novel aspects of the invention will now be described. One important aspect of the present invention is the recognition that the temporary slight increase in volume of the contracting fluid chamber 57 is caused by the radially inward movement of the roller 29, as it begins to move across the discharge arc surface portion 65. The effect of the inward movement of the roller 29, and the other aspect of the invention, relating to the arrangement of the discharge port 59, are illustrated in FIGS. 4–6.

Referring first to FIG. 4, it may be seen that roller 29 has just begun contact with the discharge arc surface portions 65, i.e., the roller 29 has just entered the "cam fall" portion of the cam surface 21. In each of FIGS. 4–6, there is shown, in addition to the surface portion 65, an imaginary line 67 of constant radius. The line 67 is included in order to illustrate changes in volume of the contracting fluid chamber 57 during cam fall i.e. the line 67 represents the maximum radius of the arc surface portion 65. It should be noted that the present invention is concerned only with the contracting fluid chamber 57 which is disposed adjacent, in a clockwise direction, to the roller 29 shown in FIGS. 4–6. Thus, the roller 29 shown in FIGS. 4–6 may be considered a "leading" roller, whereas the next roller, in a clockwise direction, would be considered a "trailing" roller.

Thus, it may be seen in FIG. 4 that with the leading roller 29 positioned at the beginning of the cam fall, there is as yet no change in the volume of the contracting fluid chamber 57. This is verified by reference to the graph of FIG. 7, on which it is indicated that when the rotor has been displaced about 102 degrees, and the leading roller is in the position shown in FIG. 4, there is no change in the volume of the fluid chamber 57, and no flow into or out of the fluid chamber 57.

Referring now to FIG. 5, the rotor 25 has turned to an angular displacement of about 111 degrees. In this position of the rotor 25 and leading roller 29, the inward displacement of the roller has increased the volume of the adjacent contracting fluid chamber 57 by an amount which is represented by a shaded area 71. The shaded area 71 corresponds to the difference between the position of the roller shown in FIG. 5, and the position the roller would have occupied (dotted line) if there had been no cam fall, i.e., no decrease in the radius of the surface portion 65. At the same time, there is a decrease in the volume of the contracting fluid chamber 57, caused by the cam fall itself. This volume decrease is represented by a shaded area 73. As may be seen in FIG. 3, the shaded area 71 (increase) is clearly greater than the shaded area 73 (decrease), and thus, there is a net increase in the volume of the chamber 57, as may be verified by reference to curves A and B in FIG. 7. Because of this net increase in the volume of the contracting fluid chamber 57, and because, in accordance with the present invention, the chamber 57 is not yet in communication with the discharge port 59, there occurs a slight vacuum in the chamber 57, which helps to maintain the roller 29 in sealing engagement with the cam surface 21.

Referring now to FIG. 6, the rotor 25 has moved to an angular displacement of about 120 degrees, and the leading roller 29 has moved further inward radially. The resulting increase in the volume of the chamber 57 is now even greater, and is represented by a shaded area 75. At the same time, the decrease in the volume of the chamber 57 caused by the cam fall, and represented by a shaded area 77, has increased to a point at which the area 77 is substantially equal to the shaded area 75, the increase caused by the roller movement.

Referring to FIG. 7, the condition of the balanced areas 75 and 77 illustrated in FIG. 6 is shown in curve A wherein the maximum volume of the chamber 57 has been reached, and in curve B wherein the flow into or out of the chamber 57 has again become zero.

In accordance with an important aspect of the invention, it is at the balanced position of FIG. 6 that the beginning of the discharge port 59 is located. In other words, as long as the volume of the contracting chamber 57 is actually increasing, it is necessary to prevent fluid communication between the chamber 57 and the discharge port 59, because such communication would result in flow from the port 59 into the chamber 57, creating turbulence and noise as was described previously. Therefore, it is only after the volume of the chamber 57 has stopped increasing, and reached a maximum, that communication between the chamber 57 and the discharge port 59 is permitted. Stated differently, the discharge port 59 is positioned such that it cannot begin communicating with the contracting volume chamber 57 until the chamber 57 actually begins to decrease its volume, e.g., after 120 degrees in the subject embodiment. However, those skilled in the art will recognize that something less than the full delay in opening the discharge port 59 to the contracting fluid chamber 57 will yield some improvement. For example, if the discharge port 59 of the subject embodiment opened at about 116 degrees, the results would be less than optimum, but there would still be a substantial reduction of turbulent flow and pressure pulses.

The present invention has been described in detail sufficient to permit one skilled in the art to practice the invention. Obviously, alterations and modifications of the invention will occur to others upon a reading and understanding of the specification, and it is intended to include all such alterations and modifications as part of the invention, insofar as they come within the scope of the appended claims.

I claim:

1. In a rotary pump of the type including housing means defining a pumping chamber, a pumping element rotatably disposed in the pumping chamber and defining expanding and contracting fluid chambers, the housing means defining a fluid inlet port in communication with the expanding fluid chambers, and a fluid output port in communication with the contracting fluid chambers, the pumping element including a rotor member mounted for rotation with an input shaft, the rotor member having a plurality of slots, each of the slots receiving a radially displaceable vane member, the vane member being configured such that radial movement thereof changes the volume of the adjacent fluid chamber, the pumping chamber being defined by a continous arcuate wall surface including an inlet arc surface of progressively increasing radius in the direction of rotation of the rotor member, and a discharge arc surface of progressively decreasing radius, each vane member being a leading vane member as it progresses across the discharge arc surface, and cooperating with a trailing vane member and the discharge arc surface to define the contracting fluid chamber, the volume of the contracting fluid chamber simultaneously being increased by radially inward displacement of the leading vane member and being decreased by the progressively decreasing radius of the discharge arc surface, and the housing means defining a discharge port disposed to permit fluid communication between the contracting fluid chamber and the fluid outlet port, characterized by:

the discharge port being located, relative to the discharge arc surface, to begin communication with the contracting fluid chamber at the point at which the decrease in the volume of the contracting fluid chamber caused by the decreasing radius of the discharge arc surface from its maximum radius approximately equals the increase in the volume of the contracting fluid chamber caused by the radially inward movement of the leading vane member.

2. The improvement as claimed in claim 1 wherein said location of the discharge port substantially prevents communication between the contracting fluid chamber and the discharge port until the contracting fluid chamber begins to undergo a net decrease in volume, with continued rotation of the pumping element, to substantially reduce fluid turbulence and pressure pulses.

3. In a rotary pump of the type including housing means defining a pumping chamber, a pumping element rotatably disposed in the pumping chamber and defining expanding and contracting fluid chambers, the housing means defining a fluid inlet port in communication with the expanding fluid chambers, and a fluid output port in communication with the contracting fluid chambers, the pumping element including a rotor member mounted for rotation with an input shaft, the rotor member having a plurality of slots, each of the slots receiving a radially displaceable vane member, the vane member being configured such that radial movement thereof changes the volume of the adjacent fluid chamber, the pumping chamber being defined by a continous arcuate wall surface including an inlet arc surface of progressively increasing radius in the direction of rotation of the rotor member, and a discharge arc surface of progressively decreasing radius, each vane member being a leading vane member as it progresses across the discharge arc surface, and cooperating with a trailing vane member and the discharge arc surface to define the contracting fluid chamber, the volume of the contracting fluid chamber simultaneously being increased by radially inward displacement of the leading vane member and being decreased by the progressively decreasing radius of the discharge arc surface, and the housing means defining discharge port means disposed to permit fluid communication between the contracting fluid chamber and the fluid outlet port, the discharge port means comprising an outer discharge port in fluid communication with the contracting fluid chamber and an inner discharge port in fluid communication with the adjacent rotor slot, characterized by:

the outer discharge port being located, relative to the discharge arc surface, to begin communication with the contracting fluid chamber at the point at which the decrease in the volume of the contracting fluid chamber caused by the decreasing radius of the discharge arc surface from its maximum radius approximately equals the increase in the volume of the contracting fluid chamber caused by the radially inward movement of the leading vane member.

4. The improvement as claimed in claim 3 wherein there is a relatively close fit between each of the rotor slots and the respective vane member to substantially prevent fluid communication between the inner and outer discharge ports, through the rotor slots, past the vane member.

5. In a rotary pump of the type including housing means defining a pumping chamber, a pumping element rotatably disposed in the pumping chamber and defining expanding and contracting fluid chambers, the housing means defining a fluid inlet port in communication with the expanding fluid chambers, and a fluid outlet port in communication with the contracting fluid chambers, the pumping element including a rotor member mounted for rotation with an input shaft, the rotor member having a plurality of slots, each of the slots receiving a radially displaceable vane member, each vane member being configured such that radial movement thereof changes the volume of the adjacent fluid chamber, the pumping chamber being defined by a continuous arcuate wall surface including an inlet arc surface of the progressively increasing radius in the direction of rotation of the rotor member, and a discharge arc surface of progressively decreasing radius, the housing means defining a discharge port disposed to permit fluid communication between the contracting fluid chamber and the fluid outlet port, each adjacent pair of vane members cooperating with the discharge arc surface to define the contracting fluid chamber as the leading vane member progresses across the discharge arc surface, the volume of the contracting fluid chamber being increased by the radially inward displacement of the leading vane member, and simultaneously being decreased by the progressively decreasing radius of the discharge arc surface, whereby there is a net increase in the volume of the contracting fluid chamber during the initial movement of the leading vane member across the discharge arc surface, and subsequently, a net decrease in the volume of the contracting fluid chamber, characterized by:

the discharge port being located, relative to the discharge arc surface, to begin communication with the contracting fluid chamber at the point at which the net increase in the volume of the contracting fluid chamber ceases, and the net decrease in the volume of the contracting fluid chamber begins.

6. The improvement as claimed in claim 1 or 3 or 5 wherein each of the vane members comprises a member having generally line-to-line engagement with the discharge arc surface.

7. The improvement as claimed in claim 6 wherein each of said vane members comprises a roller vane having a generally circular cross section.

8. The improvement as claimed in claim 5 wherein the discharge port means comprises an outer discharge port in fluid communication with the contracting fluid chamber and an inner discharge port in fluid communication with the adjacent rotor slot.

9. The improvement as claimed in claim 8 wherein there is a relatively close fit between each of the rotor slots and the respective vane member to substantially restrict fluid communication from the inner discharge port and the radially inward portion of the rotor slot, past the vane member, to the contracting fluid chamber.

* * * * *